United States Patent [19]

Graves

[11] 3,965,574

[45] June 29, 1976

[54] APPARATUS FOR FORMING A JACK-O-LANTERN

[76] Inventor: Harry Edwin Graves, 3219- 135th St., Toledo, Ohio 43611

[22] Filed: Sept. 29, 1975

[21] Appl. No.: 617,482

[52] U.S. Cl. ..... 30/124; 30/289

[51] Int. Cl.[2] ..... B26B 11/00; B26B 29/02

[58] Field of Search ..... 30/124, 289, 300, 310

[56] References Cited

UNITED STATES PATENTS

| | | | |
|---|---|---|---|
| 1,482,735 | 2/1924 | Catsules | 30/124 |
| 1,870,741 | 8/1932 | Nastrom | 30/124 |
| 1,889,912 | 12/1932 | Barcelo | 30/124 |
| 2,095,152 | 10/1937 | Reynolds | 30/289 |
| 2,521,552 | 9/1950 | Thompson | 30/124 |

*Primary Examiner*—Othell M. Simpson
*Assistant Examiner*—J. T. Zatarga
*Attorney, Agent, or Firm*—Malcolm W. Fraser

[57] ABSTRACT

A device for forming a jack-o-lantern, which is attached embracingly to a pumpkin and comprises two curved plates engaging opposite sides of the pumpkin and retained in place by cords which are laced through the adjacent edge portions of the plates. In one plate, called the main plate, are holes generally locating the eyes, nose and mouth which are to be cut from the pumpkin. A tool having a cutter is provided for each of the eyes, nose and mouth, and these are respectively mounted on the main plate. By manipulation of the tools, holes are cut appropriately in the pumpkin. The tools are operated individually by screw action, and after the forming operation is completed, the plates are unlaced and removed from the pumpkin.

2 Claims, 2 Drawing Figures

APPARATUS FOR FORMING A JACK-O-LANTERN

SUMMARY OF THE INVENTION

It has been a very difficult, if not impossible, task for small children to make their own jack-o-lantern from a pumpkin, because the thick wall militates against cutting the usual openings for the eyes, nose and mouth. According to this invention, the cutting operation is greatly simplified so that, by merely turning a knurled wheel or handle, cutting through the wall of the pumpkin is such that a child can, without difficulty, produce a jack-o-lantern of its own. In this connection, the coring out or removal of the inside of the pumpkin would preferrably be done first by others.

EMBODIMENT OF THE INVENTION

The illustrated embodiment of the invention comprises a pair of similar plates 10 and 11 which are of sheet material, such as, for example metal or plastic, and curved generally to fit on opposite sides of a pumpkin P. To hold the plates releasably in place against the pumpkin, cords 12 and 13 are laced through rows of holes 14 and tied. Other means for holding the plates together may be provided, but the cords provide an exceedingly simple device for holding the plates in the desired position. It will be understood that the plates must be held in place during the cutting operation, and while cutting is performed, an outward pressure is imposed on the plate 10, but due to the connection between the two plates, they are retained in operative position.

Formed in the plate 10 are elongate cut-outs which are appropriate for the eyes, nose and mouth of the jack-o-lantern, and are designated respectively as 15, 15*a*, 16 and 17. Mounted in each of these cut-outs is a separate cutting instrument which, upon manipulation, cuts out portions of the pumpkin wall to provide the eyes, nose and mouth.

Figure 1:
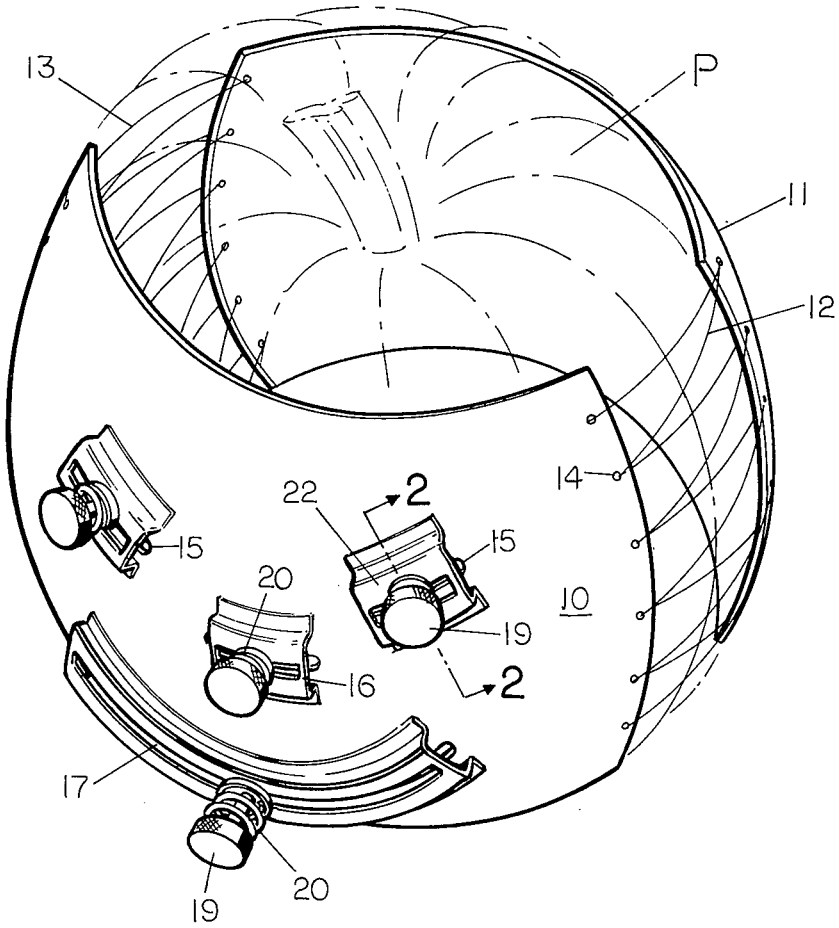
FIG. 1 is a front perspective view of the apparatus showing by broken lines a pumpkin in operative position.
Figure 2:
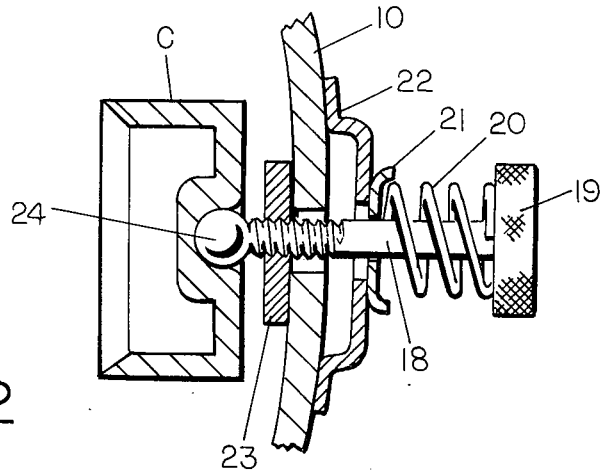
FIG. 2 is an enlarged sectional view showing an operating instrument with its cutter mounted in position of use and attached to the front pumpkin-engaging plate.

A cutting instrument is best shown on FIG. 2, and although a separate instrument is used for each of the eyes, the nose and the mouth, description of one is considered adequate. An elongate stem 18 has a screw threaded section on the inner end portion and a knurled operating wheel or handle 19 on the outer end. A coil spring 20 encircles the stem 18 and bears at one end against the inner face of the wheel 19, and at the opposite end against a dished washer 21. The washer 21 bears against the outer surface of an arched clamping plate 22 through which the stem 18 extends freely. The clamping plate 22 bears against the outside of the plate 10.

A stem 18 extends freely through each of the holes selected for the eyes, nose and mouth. Engaging the inner face of the plate 10, and screw threadedly engaging the threaded portion of the stem 18, is a clamping plate 23. On the inner end of the stem 18 is a ball-like portion 24 which has snap engagement with the outer side of a cutter C.

It will be clear that by turning the knurled wheel or handle 19, a cutter C is forced against the wall of the pumpkin P and cuts out a portion of such wall to form the appropriate opening for an eye, nose or mouth. In this connection, it will be understood that a different cutter will be used in each instance. Manifestly, for the mouth a relatively long curved cutter is needed to provide the desired mouth opening. Thus, successively the child operates the knurled wheel or handle 19 for each of the stems, and after all portions of the eyes, nose and mouth have been cut, then the cords 12 and 13 are unlaced so that the plates 10 and 11 can be moved away from the pumpkin.

Usually, it will be understood, the inside of the pumpkin is first cored and a lid cut for the top of the pumpkin in the usual manner, because these operations are usually too difficult for a small child. Otherwise, the forming of the eyes, nose and mouth of the jack-o-lantern are formed or cut out by the child so that in the main the child, by itself, has made its own jack-o-lantern.

What I claim is:

1. Apparatus for forming a jack-o-lantern comprising a. a pair of plates of sheet material curved to engage opposite sides of a pumpkin, b. releasable means for connecting the adjacent edge portions of said plates for holding same in place against a pumpkin, c. holes in one of said plates appropriately arranged for the eyes, nose and mouth of a jack-o-lantern, d. cutters shaped appropriately for the eyes, nose and mouth adapted to cut through and remove portions of the wall of a pumpkin, e. an instrument for each of said cutters to extend through the respective hole in said plate.

f. each instrument having a stem extending through a plate hole and engaging a cutter disposed on the inside of such plate, g. a clamping plate on the inside of such plate in screw threaded engagement with said stem, h. a clamping plate on the outside of and engaging such plate, and through which said stem freely extends, i. an operating wheel on the outer end of said stem, and j. a coil spring between said wheel and said outside clamping plate.

2. Apparatus as claimed in claim 1, in which said releasable means comprises cords laced respectively through rows of holes in the adjacent plate edge portions.

* * * * *